United States Patent [19]

Pittinger, Sr. et al.

[11] Patent Number: 4,612,738

[45] Date of Patent: Sep. 23, 1986

[54] ROTARY FLAIL CUTTING AND FINISHING TOOL HEAD

[76] Inventors: Charles B. Pittinger, Sr.; Cynthia A. Pittinger, both of 902 N. Lake Dr., Weatherford, Tex. 76086

[21] Appl. No.: 751,050

[22] Filed: Jul. 2, 1985

[51] Int. Cl.[4] ..... B24B 9/02

[52] U.S. Cl. ..... 51/335; 51/168

[58] Field of Search ..... 51/330, 331, 332, 333, 51/334, 335, 336, 337, 168; 16/110 R, 114 R, 115; 81/177.2, 177.1

[56] References Cited

U.S. PATENT DOCUMENTS

| | | | |
|---|---|---|---|
| 1,123,790 | 1/1915 | Parlmer | 51/168 |
| 2,125,460 | 8/1938 | Plengemeier . | |
| 2,194,577 | 3/1940 | Vonnegut . | |
| 2,430,099 | 11/1947 | Bradley . | |
| 2,474,063 | 6/1949 | Newton . | |
| 2,843,981 | 7/1958 | Block . | |
| 3,132,452 | 5/1964 | Block . | |
| 3,486,276 | 12/1969 | Block | 51/335 |
| 3,540,169 | 11/1970 | Mahoney . | |
| 3,895,440 | 7/1975 | Pittinger, Jr. | 30/47 |
| 4,020,553 | 5/1977 | Pittinger | 30/347 |
| 4,047,455 | 9/1977 | Pittinger, Sr. | 76/82.1 |
| 4,229,912 | 10/1930 | Laughlin | 51/335 |
| 4,250,623 | 2/1981 | Pittinger et al. . | |
| 4,251,958 | 2/1981 | Langenberg et al. | 51/335 |
| 4,277,917 | 7/1981 | Ali et al. | 51/335 |
| 4,369,606 | 1/1983 | Reiman | 51/334 |
| 4,493,170 | 1/1985 | Hanger | 51/330 |

*Primary Examiner*—Frederick R. Schmidt
*Assistant Examiner*—Maurina Rachuba
*Attorney, Agent, or Firm*—John F. McClellan, Sr.

[57] ABSTRACT

A rotary cutting and finishing head of the flail type can use common commercially available sandpaper or emery cloth or other sheet material. A hub of the type rotatable by drill press or hand drill, mounts, in plane, uniform length and width strips or ribbons of any of these materials on slotted tube posts coaxially fixed to the hub. Each slot is of a size to capture a fixed end of a respective ribbon on assembly. In one version, every second post is provided with a ribbon. The ribbons are then wound in a substantially circumferential direction in and out among the posts, the odd posts being merely supports for the staggered partially overlying ribbons. On rotation of the hub at high speed, when the flail end of a ribbon wears from flexing at a post, it may part and release a fresh length or flail end at adjacent location. Alternately, fresh lengths of ribbon may be deployed manually by cutting off or tearing off worn flail portions. In another version, similar in part and that is preferred, a drop-in type ribbon supply is provided. Paint can be removed from soft aluminum as thin as 1/10 mm without distortion of the aluminum. An embodiment for wet operation is also disclosed, and a reversible live handle.

2 Claims, 13 Drawing Figures

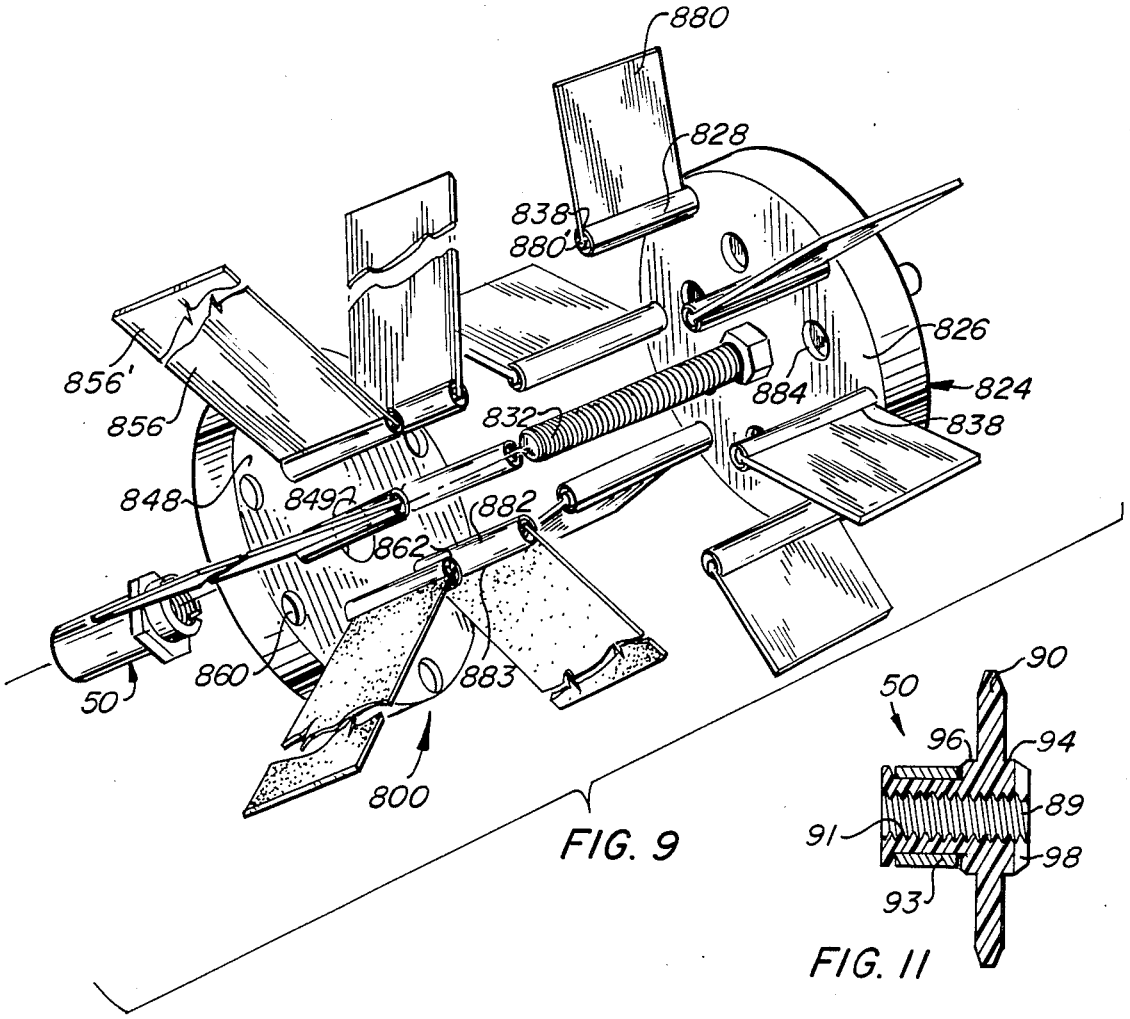
FIG. 9
FIG. 11
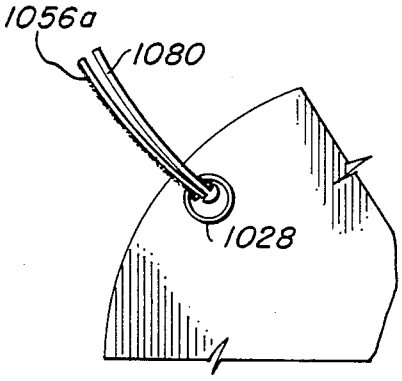
FIG. 10a
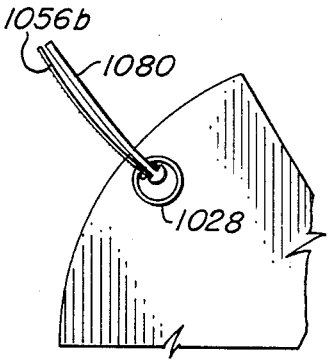
FIG. 10b
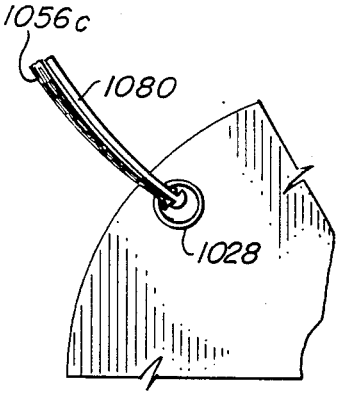
FIG. 10c

ROTARY FLAIL CUTTING AND FINISHING TOOL HEAD

FIELD OF THE INVENTION

This invention relates generally to material working and particularly to rotary tool heads of the flail type used in material working.

BACKGROUND OF THE INVENTION

Rotary tool heads with flexible abrading strips radially deployed therefrom are known. Also, self-feeding rotary devices employing filament to cut weeds and grass are known, such as disclosed in U.S. Pat. No. 4,020,553 granted on May 3, 1977 to Cynthia A. Pittinger; U.S. Pat. No. 4,047,455 granted on 9-13-77 to C. B. Pittinger, Sr., and U.S. Pat. No. 3,895,440 granted on 7-22-75 to C. B. Pittinger, Jr.

Slotted tubes retaining the inner ends of backing for abrasive strips appear in U.S. patents such as:

U.S. Pat. No. 2,474,063 to H. S. Newton, 6-21-49

U.S. Pat. No. 2,843,981 to A. Block, 7-22-58

Slotted tubes retaining the ends of abrasive strips appear in:

U.S. Pat. No. 2,843,981 to A. Block, 7-22-58

Posts adjustable in recesses appear in:

U.S. Pat. No. 2,125,460 to M. Plengemeier, 8-2-38

U.S. Pat. No. 2,194,577 to A. Vonnegut, 3-26-40

U.S. Pat. No. 2,430,099 to E. H. Bradley, 11-4-47

U.S. Pat. No. 3,540,169 to G. R. Mahoney, 11-17-70

U.S. Pat. No. 4,369,606 to R. E. Reiman, 1-25-83

Spiders and other drop-in structures appear in:

U.S. Pat. No. 2,474,063 to H. S. Newton, 6-21-49

U.S. Pat. No. 3,132,452 to A. Block, 5-12-64

U.S. Pat. No. 3,486,276 to A. Block, 12-30-69

U.S. Pat. No. 4,229,912 to W. F. Laughlin, 10-28-80

U.S. Pat. No. 4,251,958 to A. J. Langenberg et al, 2-24-81

U.S. Pat. No. 4,277,917 to C. A. Ali et al, 7-14-81

BRIEF SUMMARY OF THE INVENTION

However, it is believed that a rotary flail type abrading and polishing system of a type set forth herein, that can feed in-plane fresh flail portions has not before been disclosed, and to provide such is a principal object of this invention.

Another object of this invention is to provide a system as described that can use commonly available material as flail ribbons, and that for mounting the flail ribbons employs only three relatively movable parts, a hub, a plate and a nut, none of which moves relative to the others in operation, none of which requires close tolerances, and none of which is expensive. The nut may be part of a live handle.

And another object is to provide a system as described that holds the flail ribbons to the hub in respective, convenient, readily accessible, hollow slotted-posts.

Further objects are to provide a system of the type described that can be used for heavy or for light surface-working, and that can, in one embodiment, cushion operation of itself under centrifugal force and, in another embodiment, cushion with leaf pressure springs.

In more detail, given for cursory descriptive purposes only, and not as limitation, in one embodiment, a rotary cutting and finishing head of the flail type can use common commercially available sandpaper or emery cloth or other sheet material. A hub of the type rotatable by drill press or hand drill, mounts in plane, effectively uniform-length and width strips or ribbons of any of these materials on slotted tube posts coaxially fixed to the hub. Each slot is of a size to capture a fixed end of a respective ribbon on assembly. Every second post is provided with a ribbon. The ribbons are then wound in a substantially circumferential direction in and out among the posts, the odd posts being merely supports for the staggered, partially overlying ribbons. on rotation of the hub at high speed, when the flail end of a ribbon wears short at a post, it may slip out and release a fresh length or flail end at adjacent location. Alternatively, fresh lengths of ribbon may be deployed manually by cutting off or tearing off worn flail portions. In another embodiment, a cartridge loading second disk with slotted posts is provided. In both embodiments a live handle is an essential for most versatile performance. Either embodiment of the invention can be used with a strip of abrading or polishing ribbon attached as one arm of a "V" to a flat spring plastic strip and secured in each of the slotted posts provided around the hub-face margin. The invention is suited for both delicate work and coarse work.

Paint can be removed from soft aluminum as thin as 1/10 mm without distortion of the aluminum. An embodiment for wet operation is also disclosed. Engine cylinder bores can be deglazed to aid in the seating of new piston rings using this invention.

BRIEF DESCRIPTION OF THE DRAWINGS

The above and other objects and advantages of this invention will become more readily apparent on examination of the following description, including the drawings in which like reference numerals refer to like parts.

Figure 8:
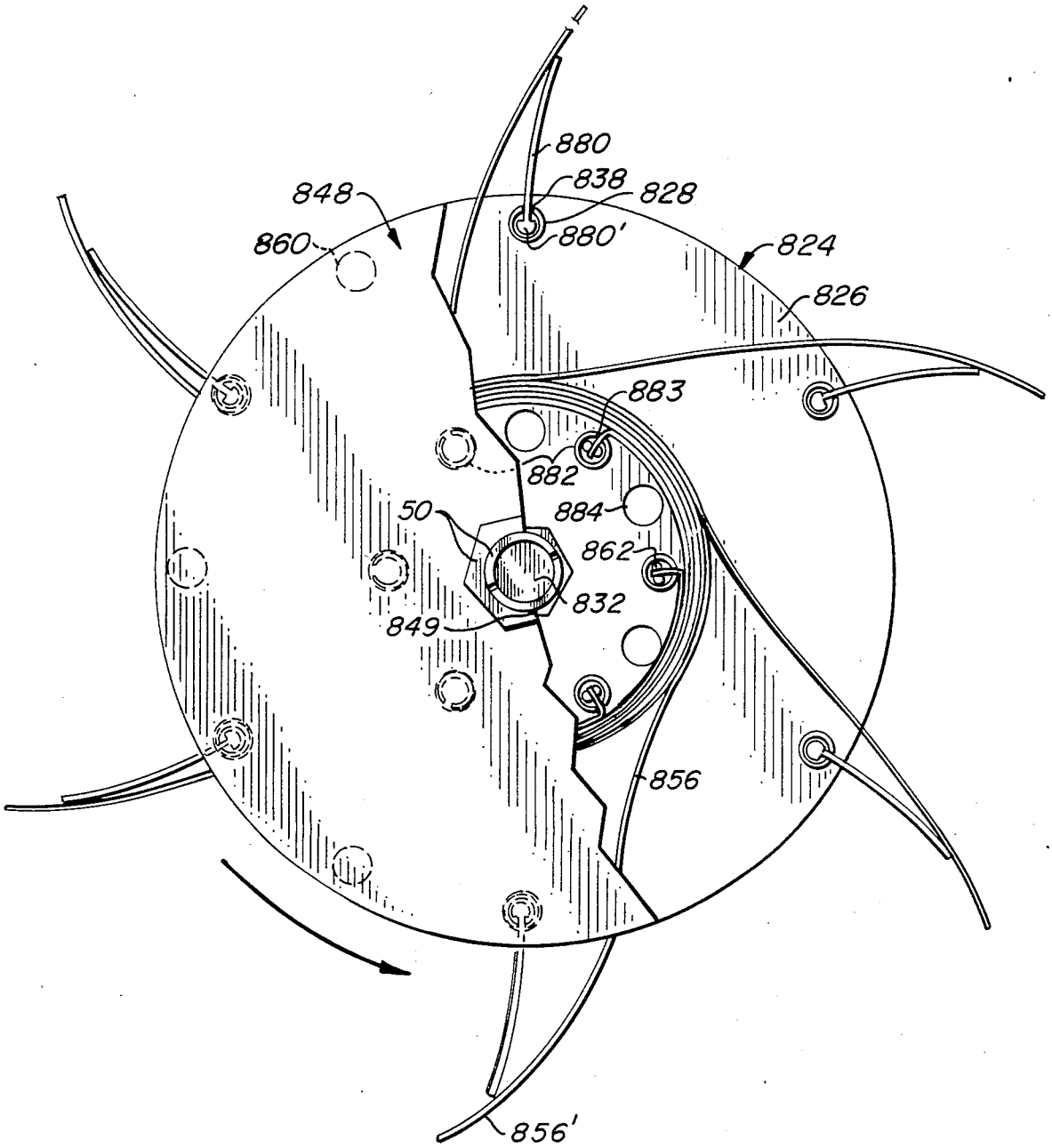

FIGS. *7a–7f* show in edge views various types of provisions for ribbon attachments to posts;

FIG. *7g* shows in edge view a plastic spring or backing with upset end;

FIG. 8 is an axial diagram of the hub showing partial assembly of a second, preferred, embodiment;

FIG. 9 is a perspective exploded diagram of the second embodiment;

FIGS. 10*a, b* and *c* are details of an optional arrangement using either the first or the second embodiment; and FIG. 11 is a section view of a live handle.

DETAILED DESCRIPTION

Figure 1:
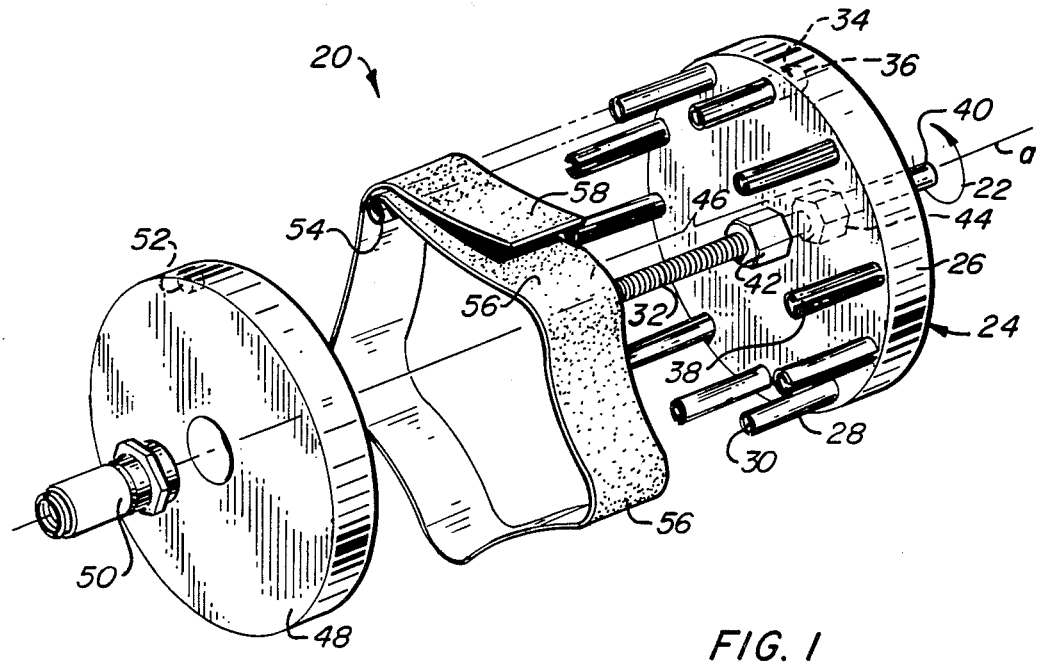
FIG. 1 is an exploded perspective view of the four relatively movable components of the invention in a first embodiment with reversible live handle.

FIG. 1 shows the invention in embodiment 20 partially assembled. Arrow 22 shows the normal direction of rotation when operating. Hub 24 includes a baseplate or disk 26 of polystyrene or other suitable thermoplastic, having an array of longitudinally slotted posts 28, in the form of circular-section slotted tubes with open ends 30. The posts 28 are spaced uniformly around the outer margin parallel with the axis "a" of the spindle 32, and parallel to each other. The posts are of resilient, tempered steel preferably, and each has a fixed end 34 force fitted into a corresponding blind hole 36 in the disk, for retention. The slots 38 preferably face radially outward. The hub assembly further includes the spindle 32. One end 40 of the spindle is a shaft portion suitable for chucking in a Jacobs chuck or the like, to rotate the hub in use. The spindle has a threaded portion passing through the disk 26 to which it secures by lock-nuts 42, 44, one on either side of the disk.

Assembled to the hub 24 by passage through the center thereof of part of the spindle threaded portion 46 is a circular plate 48 like the disk, drawn against the ends of the posts by live handle assembly 50. The live handle assembly is basically a reversible nut that screws on spindle 32 and retains circular plate 48. Either end can be oriented towards the circular plate 48. As shown, a free-spinning handle for manually steadying the system during operation is provided in one orientation. Further details are described in relation to FIG. 11. The circular plate 48 has on one face respective recesses 52 to fit loosely over the end of each of the posts.

Every second one of the posts carries in it and detachably fixed by it to the hub 24, the inner end 54 of a flexible line member or ribbon 56, that winds in-and-out among the posts 28 to a free end. This may be an abrasive ribbon such as a uniform-width rectangular strip scissor-cut from a particulate matter sheet such as sandpaper or of emery paper, or it may be a strip of fabric with a conventional polishing compound in it, either wet, as a wick, for fluid use, or for dry use. Only one ribbon is shown here, for explosion purposes. As will be indicated later, rotation of the hub as in a drill press or hand drill will cause the outer or free-end 58 of the ribbon 56 and of each of the remainder of the ribbons, not shown, to swing outward as a flail for material working from one of the circular series of posts. Rapid rotation coupled with loose winding can cause intermediate parts of the ribbons to bulge out and resiliently support the terminal ends as they contact material being worked.

Figure 2:
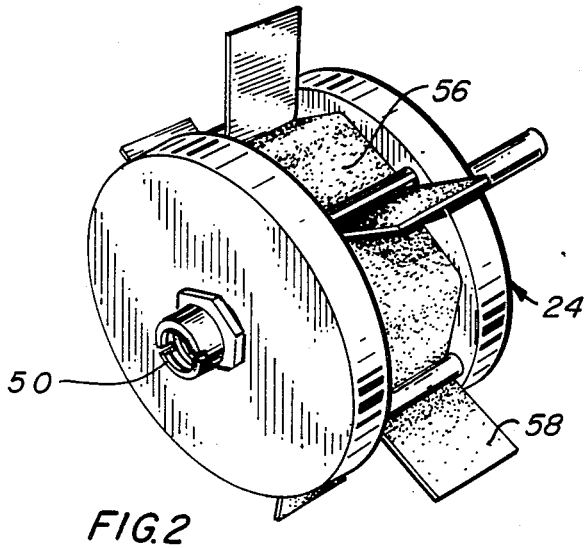
FIG. 2 is a perspective view of the hub of FIG. 1 with a full complement of abrasive ribbons thereon and disk, and live handle reversed.

FIG. 2 shows a hub 24 with a full complement of ribbons 56 wound on it. In an exemplary embodiment, ten posts for mounting and supporting five flails have been found to work well.

When a ribbon terminal end or free end 58 flexes and wears at speed, centrifugal force breaks it loose and deploys a fresh free end from the second posts ahead of it or leading it in rotation. The overlying terminal end may be helped to break free by chafing of the inner face of it at a post by the abrasive face of a ribbon next underlying it. In other words, centrifugal force and working motions cause abrading, breaking of the fibres and general failure at the breakaway point, the post. Live handle 50 is in the reversed position.

Figure 3:
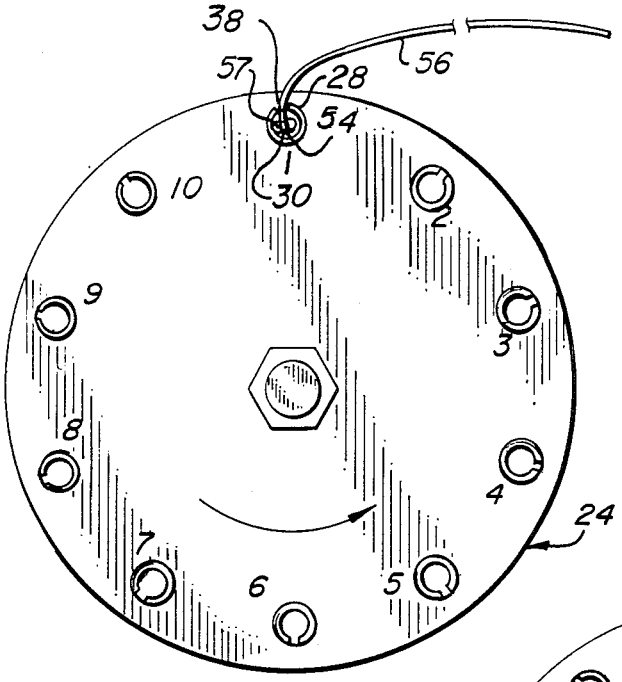
FIG. 3 is an end elevational view of the hub of the first embodiment showing an abrasive ribbon being installed thereon.

FIG. 3 shows a first step of manually winding or loading a fresh ribbon in place on an otherwise bare hub 24. In this case, a single face abrasive ribbon 56 is being used, abrasive surface out. The post positions are numbered. For securance to a post at position 1, the end 54 of the ribbon has one or more staples 57 through it to increase the size relative to the slot 38, and is pushed down in the open end hole 30 in the post 28. Fingers or pliers may be used for this.

Figure 4:
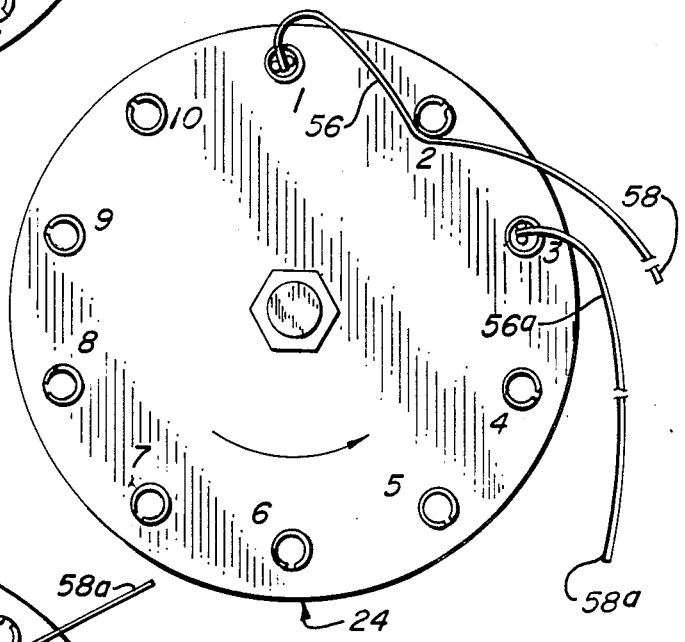
FIG. 4 is a similar view of the first embodiment with a second abrasive ribbon being installed.

FIG. 4 shows a succeeding stage of assembly. The first ribbon 56 at position 1, has been passed from post number 1 in a direction opposite the operating direction, and then passed inboard of the post at 2 and outboard of the post at 3 where it overlies ribbon 56*a* that has just been similarly wound around post 3. Post 2 and all other even numbered posts are used as supports but without ribbons depending from them. All ribbons being the same length, this assembly method staggers the ribbons a distance equal to two post spacings around the post circle. The free ends are indicated at 58, 58*a*.

Figure 5:
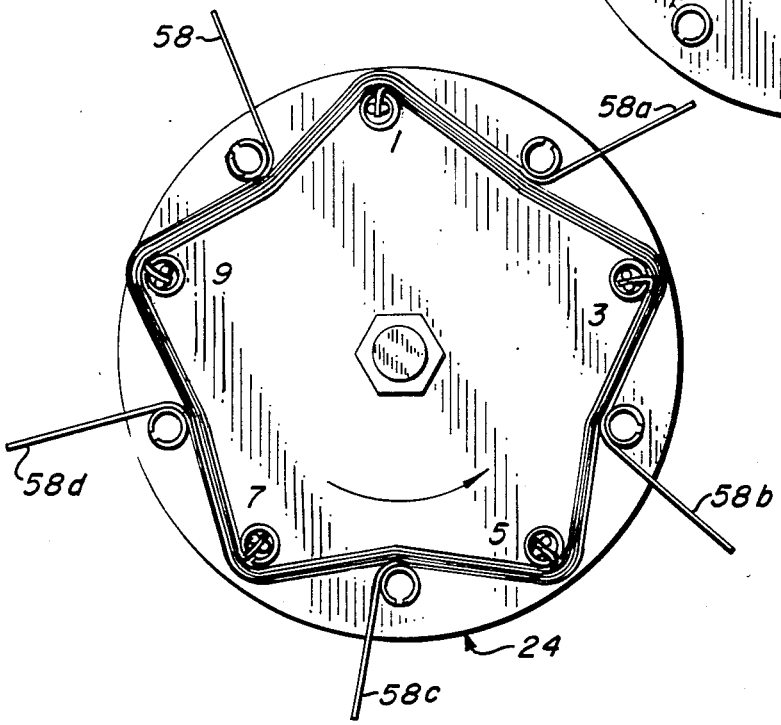
FIG. 5 is a similar view of the first embodiment with all abrasive ribbons installed.

FIG. 5 shows a completely loaded or wound hub assembly, the terminal ends or first working flail portions of the respective ribbons being indicated at 58, 58*a*, 58*b*, 58*c*, 58*d*.

Figure 6:
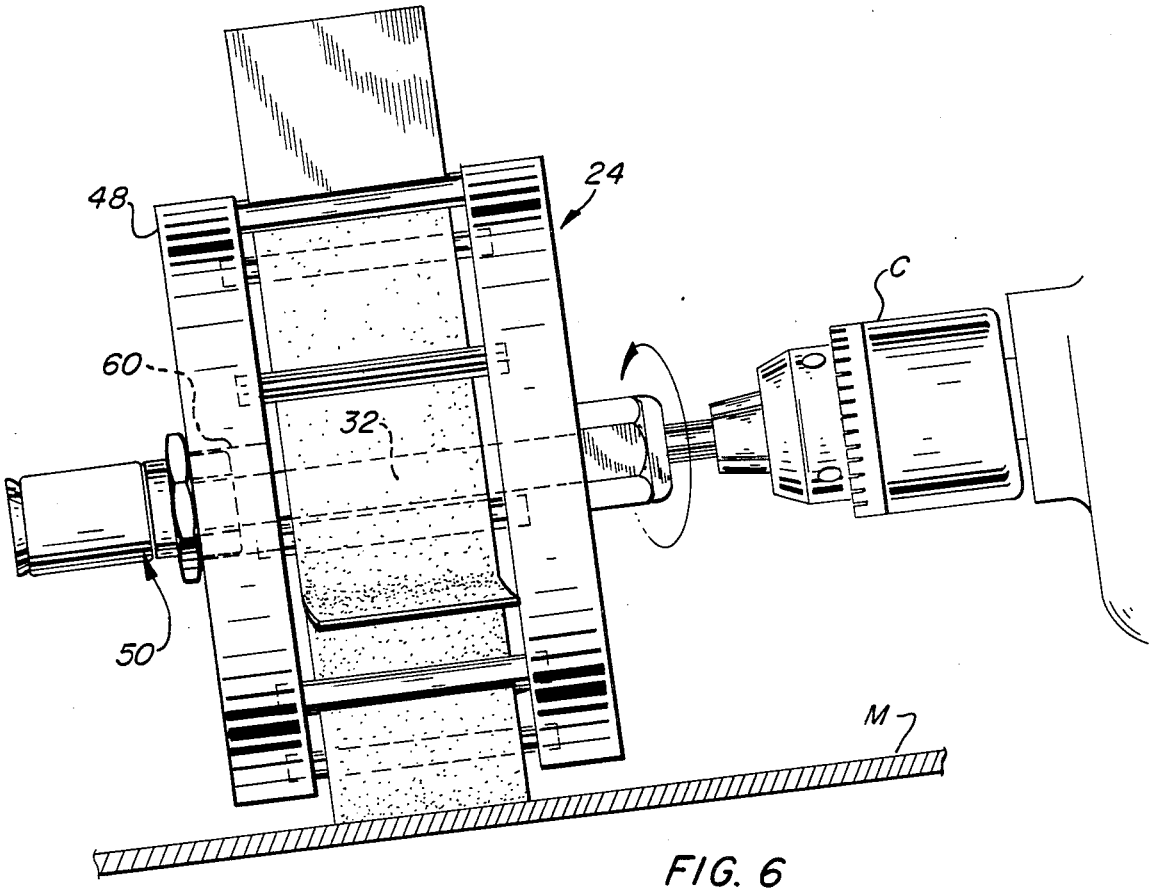
FIG. 6 is a radial view showing the first embodiment in operation.
Figure 7:
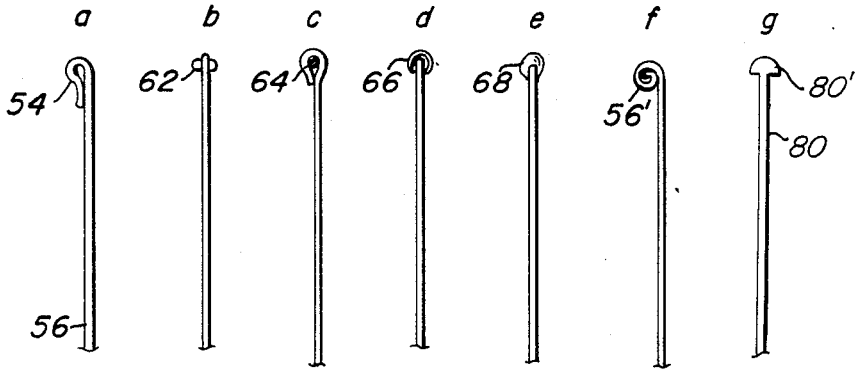

FIG. 6 shows that after the hub 24 is fully wound in this way, as a next step the plate 48 is attached by the spindle 32 through hole 60 and live handle 50, and the assembly is ready for insertion in a power drive chuck C and use in working material M.

FIGS. *7a–7f* show various means of preparing ribbon ends for insertion in posts. At *7a*, the end 54 of ribbon 56 is simply folded over; at *7b*, a common staple 62 is used to increase the size of the end; at *7c*, the end is folded over a wire 64; at *7d*, a metal "C"-clip 66 is clinched on the end with pliers; at *7e*, the end is dipped in hot plastic 68 and cooled; at *7f*, the end is rolled up at 56'.

FIG. *7g* shows how a plastic backing or spring 80 can have an upset end 80' for retention in a post.

The invention may be made in proportion to accept any width ribbon up to a full sheet, and almost any length of ribbon.

FIGS. 8 and 9 diagram elements of a preferred embodiment 800 of the invention. Shown (partly broken away in FIG. 8) is a detachable subassembly.

Hub assembly 824 includes a base plate or disk 826 with a plurality (twelve, for example, but for clarity only six are shown) of slotted posts 828 held in holes in the disk in uniformly spaced succession around the margin of the face, parallel with the threaded spindle 832 that is coaxially affixed in the disk 826, all as in the first embodiment. Each post 828 carries in the respective radially outward facing slot 838 a respective flat strip as a backup for the abrasive ribbon, a spring 880, of suitable thermoplastic such as "Nylon", retained by an upset edge 880' that is thicker than the slot. The spring is slightly shorter than the protrusion of the post in axial direction.

Particularly in FIG. 8 it should be noted to avoid confusion that disk 826 contains posts 828 and holes 884, and circular plate 848 contains posts 882 and holes 860, as will be described below.

The matching part to 826, circular plate 848, has a central hole 849 for a connection to the spindle 832 of hub 824. Coaxially affixed to plate 848 around the hole 849, parallel with the axis is a second plurality of uniformly spaced posts 882, slots 883 oriented radially outward also. Each slot retains in the respective post a staple-enlarged, or otherwise enlarged end 862 of an abrasive strip 856 or ribbon. The diameter of the inner or smaller circle in which the second plurality of posts lies is the same as that of a corresponding circle of apertures 884 in the disk 826, which apertures may radially align with the posts 828, and which circumferentially fit and hold the free ends of posts 882.

When the assembly is put together, each abrasive strip 856 emerges from the radially outward slot, in which an enlarged end, as 862, secures it, and passes by and is supported by a respective one of the springs 880, the principal part being stored over the inner posts and under the outer posts in similar manner to that taught in our U.S. Pat. No. 4,250,623, 2-17-81.

Before the threads in the live handle 50 are snugly tightened against the circular plate, the disk and the circular plate 848 may be rotated relative to each other to wind up the abrasive ribbons 856, each of which may initially be long enough to pass at least halfway around the assembly.

Initial adjustment of the abrasive ribbons 856 may be with the free ends 856' or terminal end portions protruding slightly more than the springs.

The arrow shows direction of rotation in FIG. 8.

Then the desired free-end length of the abrasive ribbons is set, the ends of the posts 882 are fitted into the apertures 884 and tightened there by spindle engagement of a nut portion at the live handle, and the assembly is ready for use. Adjustment for wear requires only loosening the free end of the spindle attachment to the threads in the live handle 50, relatively rotating the disk 826 and circular plate 848 as desired to cause more protrusion of the abrasive ribbon free ends 856', and similarly re-tightening at the live handle.

FIG. 10*a*, FIG. 10*b* and FIG. 10*c* illustrate a feature afforded by both embodiments of this invention, quick and easy changing of abrasive ribbons, as for roughing with coarse grit, and then proceeding in stages using progressively finer abrasive particle size, ending, if desired, with felt buffing strips cemented to the plastic springs. Only an outer ring of posts as at 1028 need be used.

At 1056*a* is shown a given grade of abrasive ribbon stapled at the end to a plastic spring 1080, the junction being contained in a slotted post 1028, as by a staple. At 1056*b* is shown the same arrangement with a finer grade of abrasive ribbon. At 1056*c* is shown a felt buffing strip similary secured.

This embodiment may be considered an improvement on out U.S. Pat. No. 4,250,623 which teaches quick-change cartridges for filament trimmers.

FIG. 11 details features of the live handle 50. Female threaded bore 89 secures it to the spindle threads, when the hexagonal-perimeter nut body 90 is turned. A tubular projection 91 is cemented to or otherwise made integral with the nut body 90 coaxial with the bore as an end flange that captures a free-spinning sleeve 93 that serves as a convenient handle during operation. The opposite end of the spindle may be secured in the chuck of an electric drill or other means for rotating the assembly. If the live handle is not needed for a particular job, it is simply reversed on the spindle and being of small diameter recesses itself in the axial hole (849, FIG. 8, for example) in the circular plate. The pilot hole fits snugly over either shoulder 94 or 96. A coin or screwdriver slot 98 is provided at shoulder 96.

In this, as in the other embodiments, disposing the slots of the posts radially outward provides ease in installation, and ready inspection. Further, the circular section of the posts permits ready self-alignment, in the combination.

This invention is not to be construed as limited to the particular forms disclosed herein, since these are to be regarded as illustrative rather than restrictive. It is, therefore, to be understood that the invention may be practiced within the scope of the claims otherwise than as specifically described. For example, any of the ribbons shown may be of wick-like fabric.

What is claimed and desired to be protected by United States Letters Patent is:

1. In a system for material working, of the type having: a hub rotatable about an axis, a flexible linear member having a terminal length at a free end and an end secured for rotation with the hub, means including an array of spaced, secured supports disposed on the hub about the axis for swinging the terminal length of the flexible linear member in a plane about the axis on rotation of the hub and working material by contact of the flexible linear member with material to be worked, said contact causing wear of the flexible linear member, and means for causing wear to part said flexible linear member and to extend a further length thereof as a fresh working length during said rotation, a plurality of said flexible linear members adjacent and in said plane, each flexible linear member being a ribbon of sheet-like material, said ribbons being wound in a generally circumferential direction in-and-out among said array of supports, each of said ribbons being circumferentially staggered in relation to next adjacent said ribbons, the improvement comprising in combination: a live handle on said axis for permitting steadying said ribbons against material to be worked, structure forming a hole in a circular plate, the live handle comprising a threaded tube with an enlarged portion forming opposed shoulders thereon, the enlarged portions and the shoulders being proportioned respectively for pressing against the margins of a structure forming the hole in said circular plate and for fitting within said hole, a rotatable handgrip on said tube in the form of a sleeve therearound, and means providing for the sleeve to be extended for use or to be recessed within said disk comprising the sleeve being smaller in diameter than said hole and the live handle being reversible on said axis for receiving the sleeve in the disk when not in use.

2. In a system for material working, of the type having: a hub rotatable about an axis, a flexible linear member having a terminal length at a free end and an end secured for rotation with the hub, means including an array of spaced, secured supports disposed on the hub about the axis for swinging the terminal length of the flexible linear member in a plane about the axis on rotation of the hub and working material by contact of the flexible linear member with material to be worked, said contact causing wear of the flexible linear member, and means for causing wear to part said flexible linear member and to extend a further length thereof as a fresh working length during said rotation, the improvement comprising: a plurality of said flexible linear members each being a ribbon of sheet-like material, said ribbons being wound in a generally circumferential direction in-and-out among said array of supports, each of said ribbons being circumferentially staggered in relation to next adjacent said ribbons, a live handle on said axis for permitting steadying said ribbons against material to be worked, means for cushioning contacts of the terminal lengths with material worked, including: said ribbons being substantially the same size, a portion of each being overlain sufficiently loosely among the supports for centrifugal force of said rotation to cause intermediate parts of said ribbons to bulge outwardly between supports among which wound and yieldably back up said terminal ends, the securing of said supports including said supports comprising slotted tubes of circular cross-section, each slotted tube being of resilient material, with an end resiliently fitting a respective hole in the hub, a second array of posts being slotted and having circular cross-section and said means securing including a staple in each said ribbon and within a respective slotted post, structure forming a hole in a circular plate, the live handle comprising a threaded tube with an enlarged portion forming opposed shoulders thereon, the enlarged portion and the shoulders being proportioned respectively for pressing against the structure forming the hole in said circular plate and for fitting within the hole, a rotatable handgrip on said tube in the form of a sleeve therearound and means providing for the sleeve to be extended for use or to be recessed within said disk comprising the sleeve being smaller in diameter than said hole, and the live handle being reversible on said axis for recessing the sleeve within the disk when not in use.

* * * * *